US005951339A

United States Patent [19]

Chaillot et al.

[11] Patent Number: 5,951,339

[45] Date of Patent: Sep. 14, 1999

[54] FEMALE ELECTRICAL CONTACT TERMINAL WITH A REINFORCED STRUCTURE

[75] Inventors: Georges Chaillot, Nogent la Roi; Patrice Cappe, Faverolles, both of France

[73] Assignee: Framatome Connectors International, Courbevoie, France

[21] Appl. No.: 08/863,199

[22] Filed: May 27, 1997

[30] Foreign Application Priority Data

Jun. 3, 1996 [FR] France ..... 96 06787

[51] Int. Cl.[6] ..... H01R 11/22

[52] U.S. Cl. ..... 439/852

[58] Field of Search ..... 439/852, 851, 439/595, 843, 845, 862

[56] References Cited

U.S. PATENT DOCUMENTS

| | | | |
|---|---|---|---|
| 4,453,799 | 6/1984 | Inoue | 439/861 |
| 4,834,681 | 5/1989 | Chaillot | 439/852 |
| 5,338,229 | 8/1994 | Egenolf | 439/839 |
| 5,607,328 | 3/1997 | Joly | 439/852 |

FOREIGN PATENT DOCUMENTS

| | | | |
|---|---|---|---|
| 0 313 253 A2 | 4/1990 | European Pat. Off. . | |
| 0 694 992 A1 | 1/1996 | European Pat. Off. . | |
| 0 697 752 A2 | 2/1996 | European Pat. Off. | H01R 13/115 |
| 2 627 020 | 8/1989 | France | H01R 11/22 |

*Primary Examiner*—Neil Abrams
*Assistant Examiner*—T C Patel
*Attorney, Agent, or Firm*—Pollock, Vande Sande & Amernick

[57] ABSTRACT

Female electrical contact terminal obtained from a single electrically conducting metal sheet having a rear part (14) enabling it to be connected to an electrical conductor (20) and a front part in the form of a cage (10) consisting of an end (22), of two side walls (26), which are provided with flaps (46) for guiding a male contact during its insertion and with means for fixing this cage in connection housings, and of two upper half-walls in which each flap (46) has a width (L) approximately equal to the internal width defined by the walls of the terminal (10).

5 Claims, 4 Drawing Sheets

FEMALE ELECTRICAL CONTACT TERMINAL WITH A REINFORCED STRUCTURE

FIELD OF THE INVENTION

The present invention relates to a one-piece female electrical contact terminal, made of cut and formed sheet metal, intended to receive a male contact. It relates more particularly to a terminal of the type comprising a front body in the form of a cage having an end, an upper wall and two side walls each having an internal tab which is joined to them by a 180°-fold and which at the front has a cantilevered part constituting a contact blade.

BACKGROUND OF THE INVENTION

Contact terminals of the type defined above are already known, these being able to be manufactured by cutting, folding, forming and possibly rolling of a sheet of metal strip much more economically than lathe-cut terminals. On the other hand, existing contacts made of cut and formed sheet metal have a number of drawbacks. If the contact blades initially bear against each other and require great force to separate them, (which is conducive to establishing a high contact pressure guaranteeing an electrical connection of good quality), the insertion force is also great, and insertion may be difficult. This first drawback may become aggravated if a large number of contact terminals are provided in the same connector. If, on the other hand the contact blades are initially separated, the pressure exerted by each contact blade may in some cases be insufficient to ensure good electrical connection.

One solution to this technical problem has been provided in Patent Application FR-A-2,621,180 which describes a female contact terminal which simultaneously guarantees satisfactory electrical connection and provides guidance of the male contact while it is being introduced. Thus each side wall has, at the front, a flap folded over inwards, retaining the flexurally prestressed contact blade in a position in which it is not in contact with the other contact blade.

At the present time, many contact terminals made of folded sheet metal are subject to the additional risk of being crushed while they are being handled in production or at the premises of harness manufacturers. This is particularly the case with female electrical contact terminals in the form of a cage, but having a single wall, such as those described in Patents U.S. Pat. No. 4,453,799 or a reinforced structure. EP-A-0,697,752, or with those having contact blades which are not prestressed and which do not contribute to the stiffness of the cage, as described, for example, in Patent Application FR-A-2,627,020.

Single- or double-wall electrical terminals must moreover withstand any pull-out action or shearing action of the metal strip of which they are made. Thus, because of the cutting-out, forming and bending operations performed on these thin metal sheets, the intersections of the cutting lines may shear and tear due to a lateral mechanical thrust being exerted on or parallel to a wall.

This risk is particularly high in the thinned regions, such as the transition region between the rear part for connection to an electrical wire and the front part formed by the cage, or in the windows of the cage which are provided for fixing the terminal in plastic housings of the connectors receiving terminals.

Finally, mention should be made of the risk of the forcible introduction of a male contact whose dimensions are greater than the internal dimensions of the cage, which contact would consequently apply a pressure, on the contact blades, which exceeds the elastic deformation limit of the metal of which the contact blade is made, which would lead to eventual deterioration of the blades.

These drawbacks become particularly important when, for economic reasons, the manufacturers, anxious to reduce costs without impairing quality, envisage reducing the thickness of the metal strip of which the single electrically conducting metal sheet is made.

SUMMARY OF THE INVENTION

The invention provides a female electrical contact terminal obtained from a single electrically conducting metal sheet having a rear part enabling it to be connected to an electrical conductor and a front part in the form of a cage consisting of a wall defining an end, of two upper half-walls, two side walls provided with means for guiding a male contact during its insertion, the guiding means being in these form of flaps, and with means for fixing this cage in connection housings, and two upper halfwalls. According to the invention, each flap has a width approximately equal to the internal width defined by the walls of the terminal.

According to another characteristic of the invention, each flap has at least one tenon immobilized in a corresponding slot in the walls of the terminal.

BRIEF DESCRIPTION OF THE DRAWINGS

The invention will be more clearly understood on reading the description which follows of a particular embodiment of the invention, given by way of example, and with reference to the drawings which accompany it, in which.

DESCRIPTION OF PREFERRED EMBODIMENT

Figure 1:
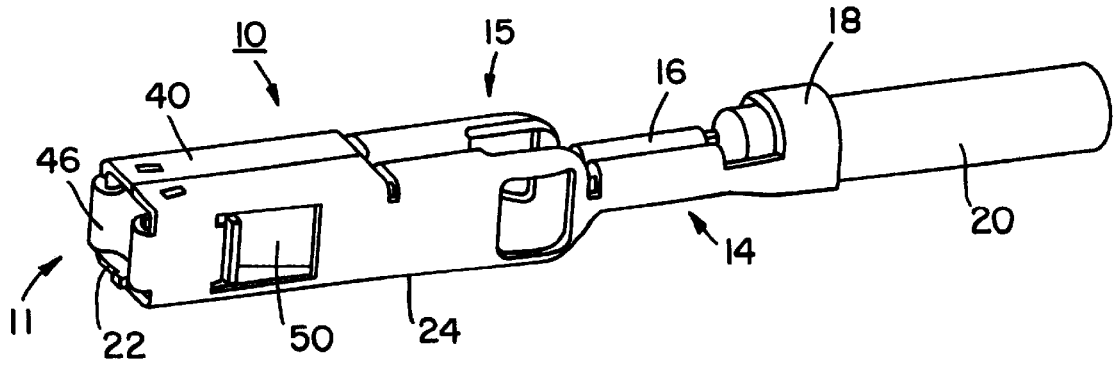
FIG. 1 is a perspective view showing a female electrical contact terminal according to the invention.
Figure 2:
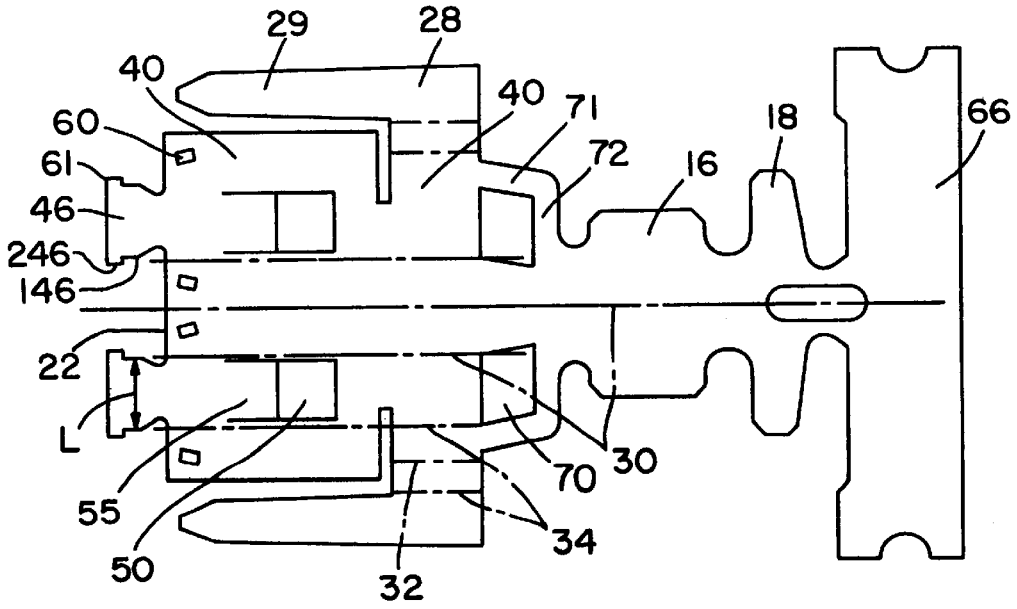
FIG. 2 is a plan view of a sheet intended to be folded, in order to make the terminal of the invention.

The terminal whose final construction is shown in FIGS. 1 and 3 to 6, produced from a sheet of the kind shown in FIG. 2, is intended to be inserted into a connector housing whose general construction may be conventional. The terminal 10 is made of a single piece, and may be regarded as having a front body 11 intended to receive a male contact 12 and a rear part or stem 14 to be crimped. These two parts are separated by a transition region 15. The stem 14 has two sets of tabs 16 and 18, respectively intended to be crimped onto the core and onto the sheath of an electrical wire 20.

The body of the terminal 10 is in the form of a cage having an end 22 and two sides 24. Each side 24 is double. It comprises an external wall 26 and an internal tab 28. The external walls 26 are is produced by folding the original sheet at 90° along fold lines 30, indicated by the dot-dash lines in FIG. 2. The internal tabs 28 are connected to the external walls 26 by a 180°-fold along fold lines 32 in FIG. 2. The two together, wall 26 and tab 28, make a right-angled fold along lines 34 in FIG. 2.

As may be seen in FIG. 2, only the rear part of each internal tab 28 is joined to the corresponding external wall 26. The front part of each internal tab 28 thus forms an elastic bearing contact blade 29 which generates a pressure on the surface of the male contact 12 when the latter is inserted.

In another embodiment (not shown) each contact blade 29 is divided by a slit over part of its length starting from the free end, which allows more uniform bearing; however, this division is not absolutely necessary. One or both of the contacts could have no slit. Conversely, more than one slit may be provided in each contact blade.

Between the wall 26 and the tab 28, a wall part close to the 180°-fold forms a half-ceiling of the cage. In the embodiment shown, the cutting of the original sheet leaves tabs 40 which bear in abutment against one another and form a continuous ceiling in the cantilevered region of the contact blades 29. This latter solution reduces the risks of the terminals catching on each other when they are grouped together in bundles or when loose, and ensures complete protection of the contact blades.

Figure 3A:
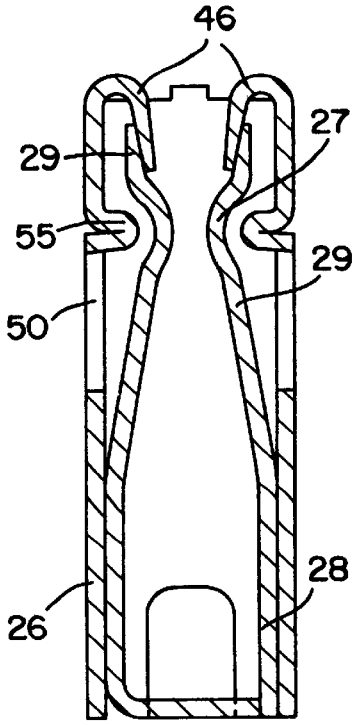
FIGS. 3A and 3B are sectional views of the front part in the form of a cage.
Figure 3B:
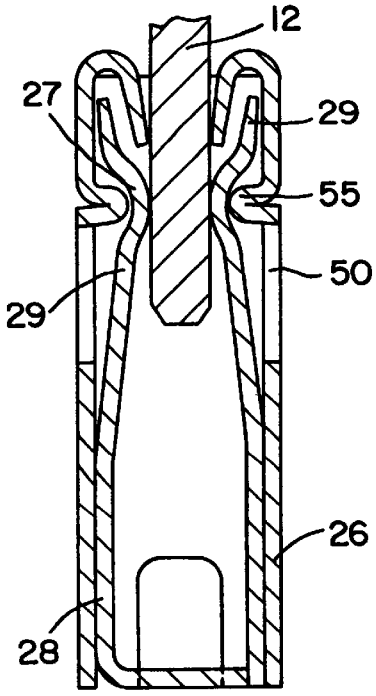
Figure 4:
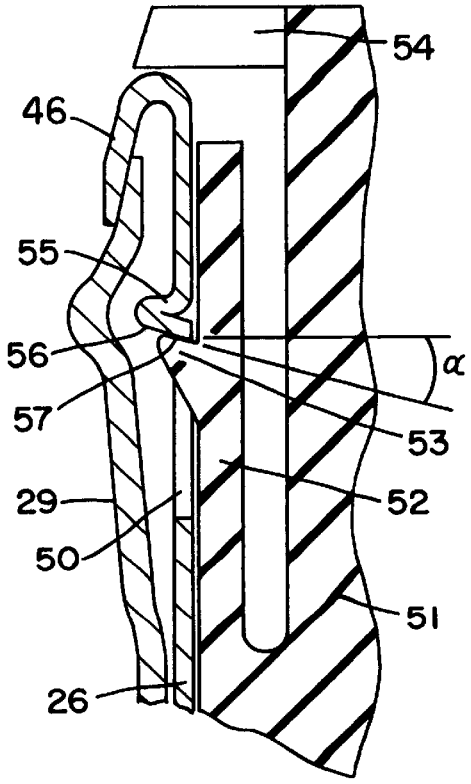
FIG. 4 is a partial section of a terminal positioned in an insulator.

Advantageously, each contact blade 29 has a shape of the kind shown in FIGS. 3 and 4. The cantilevered part, forming the electrical contact, represents somewhat more than half the total length of the internal tab 28 and is formed so as to bow inwards. In addition, it has a thickened bent part 27 facing the other contact blade, in the immediate vicinity of its free end. The elastic force due to the bowing of the contact blade 29, tending to move the two blades closer to each other, is absorbed by a flap 46, folded over towards the rear, of the corresponding external wall 26. This flap 46, which in addition enables the male contact to be guided during its insertion, thus retains the flexurally prestressed contact blade 29 in a position close to the external wall 26 to which it is linked, i.e., in a position in which it is not in contact with the opposite contact blade 29. It may be seen in FIG. 1 that the fold of the flaps lies in front of the terminal edges of the side walls of the cage and has a rounded shape, which makes it easier to introduce the terminal into the insulator 51 of a connector housing, (not shown), and reduces the risks of damaging this insulator. In order to further reduce the risk during introduction, the edges of the end and of the ceiling may be softened.

In the external walls 26, there are windows 50 intended to enable the terminal to be immobilized in an insulator 51 by means of a locking finger 52 which may have any conventional structure. In the embodiment shown in FIG. 4, this finger consists of an elongate beam made during the molding of the insulator, having a projection 53 facing the inside of the cavity of the insulator and able to be engaged in the window 50. Because the beam 52 extends in front of the projection 53, it is possible to unlock the terminal by pushing in a tube through the front passage 54 of the insulator (delimited by an annular lip having a gap allowing the beam 52 to be mounted), this tube sliding between the side of the terminal and the beam. Because of the symmetrical positioning of the two windows 50, the terminal may occupy one of the two symmetrical positions in the cavity of the insulator.

As may be seen in FIGS. 2 to 4, the window 50 on one of its sides has a wall portion which during manufacture allows production of a deformation of the metal strip so as to form a fold 55. This fold 55 defines a shoulder whose lower surface 56 is intended to bear against the upper bearing surface 57 of the projection 53 enabling the terminal to be fixed in the cavity of the insulator.

It will be noted that the end of this deformation 55 faces inwards and forms a stop acting on the outer surface of the contact blade 29 so as to avoid any risk of exceeding the elastic limit of the blade.

This arrangement, combined with the arrangement described above in which the flap 46 retains a flexurally prestressed contact blade 29, thus enables the contact pressure of the blade on the male contact to be continuously controlled throughout the life of the terminal, at each insertion of the latter.

The advantage of such an arrangement is that, by virtue of the two deformations, namely, the flap 46 and the fold 55, a clearance space is defined which delimits the movement of the contact blade 29 between a so-called passive position, in which it is retained by the flap 46 and when no male contact has been inserted, and a so-called active position, in which it limits the maximum outward movement of the blade due to the force created by introduction of the male contact.

As may be seen in FIG. 3, the folds 55 of the two external walls 26 converge in the same horizontal plane so that the points of contact, on the one hand, between the male contact 12 and the contact blades 29 and, on the other hand, between the contact blades 29 and the folds 55, define a space which eliminates any possibility of introducing a male contact not conforming to the dimensions of the female terminal.

As depicted in FIG. 4, the fold 55 has two orientations. The first folding operation turns part of the precut strip so as to face the center of the terminal, and than a second operation turns the same part of the strip through 180° so as to face the outside of the terminal, thus reinforcing the mechanical integrity of the shoulder formed by the fold 55. Moreover, it will be noted that the lower surface 56 of the fold 55 has a large area for bearing on the upper surface 57 of the projection 53; this avoids any risk of the sheet shearing despite the reduction in thickness of the strip. This surface 56 is substantially greater in area than the bearing surface 57 so that the force exerted on these surfaces is as uniform as possible and does not produce a cantilever.

The respective planes of the complementary bearing surfaces 56 and 57 define an angle a with the plane perpendicular to the longitudinal axis of the terminal, so that their respective opposite slopes create a selfengaging effect between the terminal and the insulator. By way of example, the value of the angle $\alpha$ of the surface 57 of the projection is between 1° and 45°, and preferably about 15°.

Figure 7:
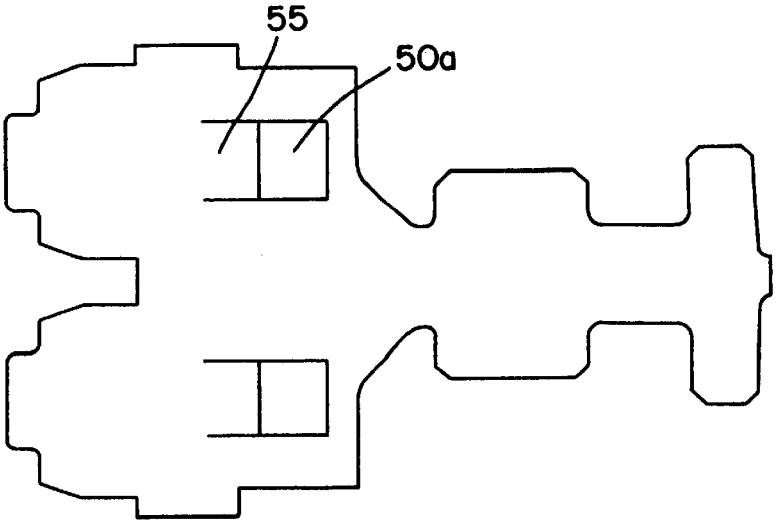
FIG. 7 PRIOR ART
FIG. 7 is a plan view of a sheet intended to be folded in order to make a terminal of the prior art.

Referring to FIG. 7, it will be noted that the windows 50*a* in the walls of the electrical terminals of the prior art may clearly include the folds 55, although these walls are single walls.

Figure 5:
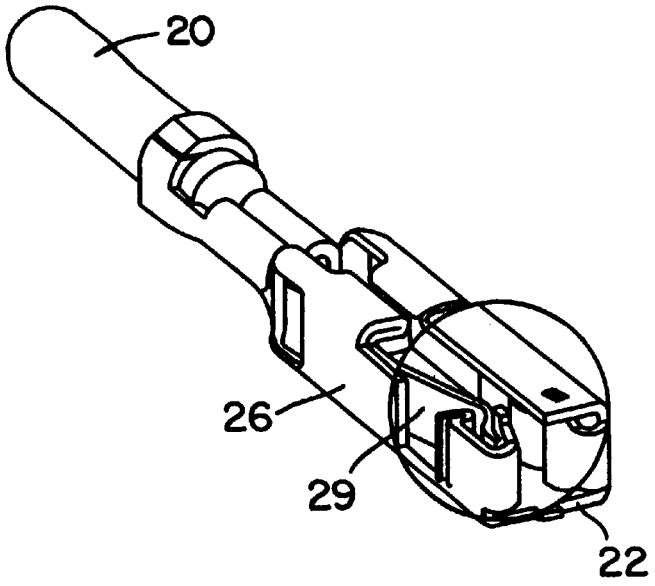
FIGS. 5 and 5A are two perspective views with a cut-away part showing the terminal in FIG. 1.
Figure 5A:
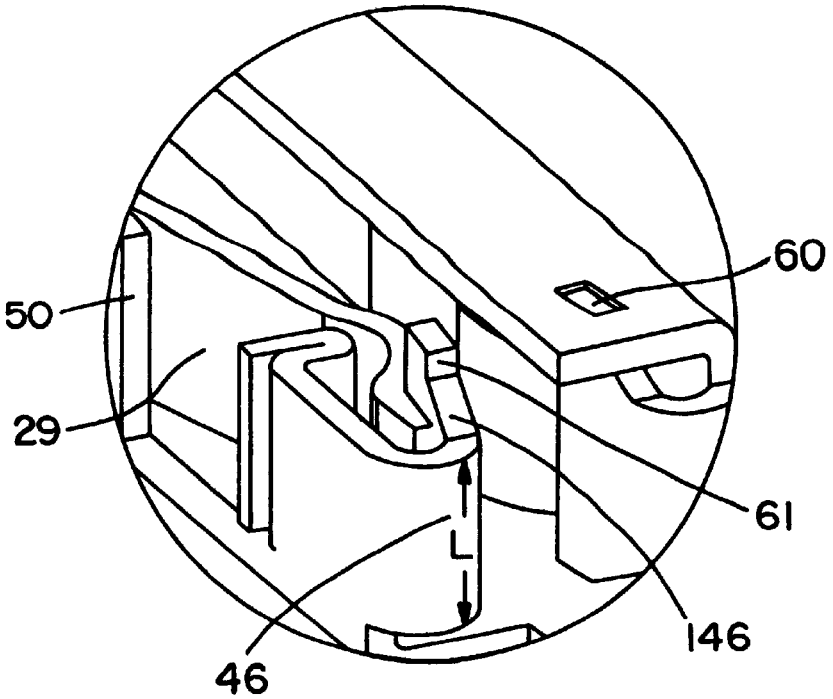

FIGS. 5 and 5A show a device for strengthening the terminal 10. For the purpose of compensating for the reduction in the thickness of the sheet, the flap 46 has a width L approximately equal to the internal width defined by the walls of the terminal once folded over so that the lateral edges of the flaps 46 come to bear on the inner surface of the end and of the upper walls of the terminal. Furthermore, these walls are provided with openings 60 engaged by tenons 61 on the ends of the lateral edges of the flaps 46.

Flap 46 comprises a section 146 whose width increases in the direction of the free end of the flap, as well as a section 246 of a width such that, once the flap is folded, edges of section 246 bear on the inner surface of the end wall and the upper wall of the cage.

Apart from the fact that the flaps 46 are thus solidly fixed, this strengthening of the cage forming the terminal 10 enables the walls of this cage to be braced and prevents any accidental crushing.

It will be noted that the flaps 46 may be fixed in the cage by a single tenon 61 provided on one of the lateral edges of the flap 46.

Figure 6:
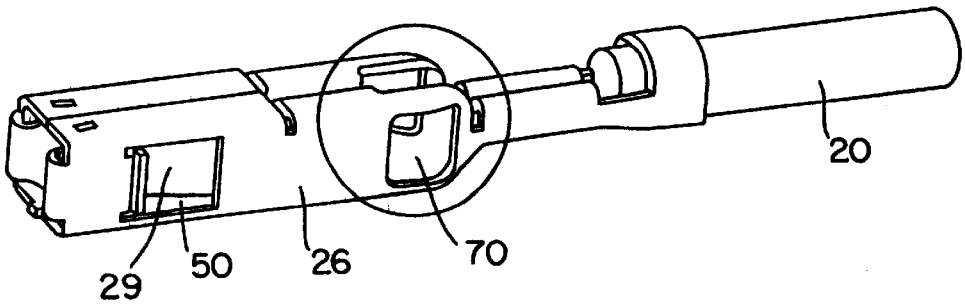
FIGS. 6 and 6A are two perspective views with a cut-away part showing another detail of the terminal in FIG. 1.
Figure 6A:
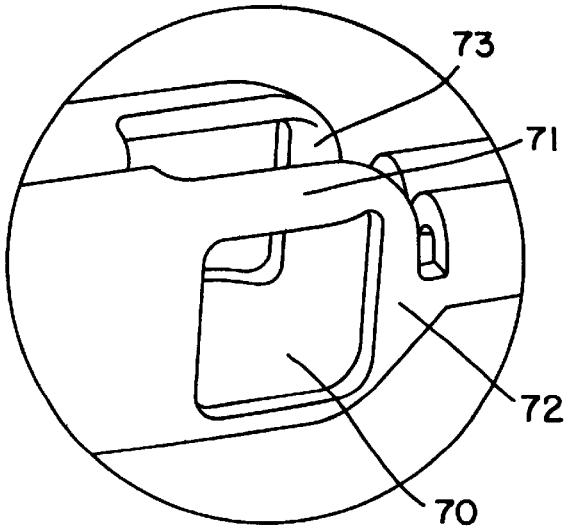

FIGS. 6 and 6A show another arrangement suitable for increasing the mechanical rigidity of the terminal in general.

In fact, between the front body 11 of the terminal 10 and the stem 14 to be crimped, there is a so-called transition region 15 which may undergo deformations or misalignments prejudicial to installing the terminals in the insulators.

In these figures, it may be seen that this transition region is smaller. This is because the walls 26 of the front body 11 are extended by two right-angled branches 71 and 72 which, with the end 22 and the wall 26, define an opening 70, thus consisting of four sides which together strengthen this partially cut-away region. Opening 70 allows the introduction of any device for the secondary lateral locking of the terminal in a connector housing. Likewise, it should be noted that provided between the two right-angled parts, each arranged on a wall 26, is a space 73 which allows positioning of the end of any wire to be crimped which slightly exceeds the required dimensions, thus preventing this wire from pushing the terminal beyond the required standards for correct positioning of the terminal in its insulator.

A brief description will now be given of a possible process for manufacturing the terminals according to the invention, making it possible to obtain the terminals in the form of tapes for feeding a machine which automatically crimps onto wires.

In the case of the terminals of the invention which are intended for the motor-vehicle industry, the manufacture takes place by cutting and forming (folding) of strips of copper alloy having a thickness of 0.29 mm. At a first work station, the strip is cut in order to create successive sheets of the kind shown in FIG. 2, these being joined together by a connecting strip 66. The fold lines, indicated by the dot-dash lines in FIG. 2, may be marked out in a press. The contact blades 29 are shaped by bending and striking, and the flaps 46 are formed. As may be seen in FIG. 4, it is advantageous to give both the flaps and the free terminal part of the contact blades 29 a slope, for example of about 15° , which makes it easier to introduce the male contact.

The 180°-fold between the internal and external tabs and walls and the 90°-fold inwards separating the part of the internal tab belonging to the side and that belonging to the ceilings are formed; simultaneously, the tenons 61 penetrate the windows 60 and the walls formed come into contact with the edges of the flaps 46.

Many variants of the invention are possible. For example, it is possible to form a terminal whose faces are not exactly parallel but exhibit a slope; a notch allowing passage of the angled male blade, this being required for certain sealing embodiments, which is intended to receive a sealing tab may be provided at the front of the ceiling of the contact.

We claim:

1. A female electrical contact terminal obtained from a single electrically conducting metal sheet having a rear part enabling it to be connected to an electrical conductor and a front part in the form of a cage consisting of a bottom wall, of two side walls which are provided with flaps for guiding a male contact during insertion of said male contact, and with means for fixing the cage in a connector housing, and of two upper half-walls, each flap having a width approximately equal to an internal width defined by the walls of the terminal, lateral edges of said flap coming to bear on the bottom wall and one of said upper half-walls of said terminal, wherein each flap has at least one tenon immobilized in a corresponding slot in the walls of the terminal.

2. The female electrical contact terminal according to claim 1, wherein each flap comprises a first section having a width which increases toward a free end of said flap.

3. The female electrical contact terminal according to clam 1, wherein each flap comprises a second section having a width such that, after folding of said flap, said flap comes to bear with edges of said second section on an inner surface of the end wall and the upper wall of said cage.

4. A female electrical contact terminal obtained from a single electrically conducting metal sheet having a rear part enabling it to be connected to an electrical conductor and a front part in the form of a cage consisting of a bottom wall, of two side walls which are provided with flaps for guiding a male contact during insertion of said male contact, and with means for fixing the cage in a connector housing, and of two upper half-walls, each flap having a width approximately equal to an internal width defined by the walls of the terminal, lateral edges of said flap coming to bear on the bottom wall and one of said upper half-walls of said terminal, wherein each flap comprises a first section having a width which increases toward a free end of said flap.

5. The female electrical contact terminal according to claim 4, wherein each flap comprises a second section having a width such that, after folding of said flap, said flap comes to bear with edges of said second section on an inner surface of the bottom wall and the upper wall of said cage.

* * * * *